US006220700B1

(12) United States Patent
Haigo

(10) Patent No.: US 6,220,700 B1
(45) Date of Patent: Apr. 24, 2001

(54) INK JET RECORDER

(75) Inventor: Hideaki Haigo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/267,662

(22) Filed: Mar. 15, 1999

(30) Foreign Application Priority Data

Mar. 31, 1998 (JP) ..... 10-085296

(51) Int. Cl.[7] ..... B41J 2/175; B41J 2/18; B41J 2/19

(52) U.S. Cl. ..... 347/85; 767/37

(58) Field of Search ..... 347/37, 85

(56) References Cited

U.S. PATENT DOCUMENTS 5,969,735 * 10/1999 Haigo ..... 347/85

FOREIGN PATENT DOCUMENTS 10-129003 * 5/1998 (JP) ..... 347/85

* cited by examiner

*Primary Examiner*—Huan Tran
(74) *Attorney, Agent, or Firm*—Oliff & Berridge, PLC

(57) ABSTRACT

An ink jet recorder includes an ink jet head that is movable in the vertical direction, an ink tank for supplying ink to the head, a detector for detecting the position of the head in the vertical direction, and a moving device for raising and lowering the ink tank. The ink tank moving device changes the vertical position of the ink tank in response to vertical positions of the head detected by the detector. The ink tank moving device is made up of a rack attached to the tank, a pinion gear, and a pinion drive motor. The pressure on the ink supplied to the ink jet head from the ink tank can be made more or less constant, irrespective of the height position of the ink jet head, so that good printing performance can be secured.

21 Claims, 3 Drawing Sheets

INK JET RECORDER

BACKGROUND OF THE INVENTION

1. Field of the Invention

This invention relates to an ink jet recorder that comprises a print head capable of moving vertically up and down relative to the recording paper, and particularly to an ink jet recorder exhibiting good printing performance irrespective of the vertical position of the print head relative to the recording paper.

2. Description of the Related Art

There are two common types of ink jet recorder, namely the integrated head-ink tank type of recorder wherein a small capacity ink tank is contained integrally in the print head, and the separate head and ink tank type of recorder which comprises a large capacity ink tank positioned independently of the print head and wherein ink is supplied to the print head via a tube from the ink tank. Among the latter type of recorder are those which, in view of design or space considerations, or because of the existence of a plurality of printing areas, comprise a print head that can be moved vertically inside the main recorder unit and thus have its up and down position changed.

In the separate head and ink tank type of recorders having print heads that can be moved up and down, the ink tank is fixed in a stationary position, wherefore, when the vertical position of the print head is changed, the positional relationship in the vertical dimension between the print head and the ink tank changes accordingly. As a result of changes in this positional relationship, the back pressure (water head) acting on the print head varies, which can have an adverse effect on printing performance.

SUMMARY OF THE INVENTION

The present invention has been devised in view of the such defects in recorders based on the prior art. An object of the present invention is to provide an ink jet recorder wherein the printing position is varied in the up and down direction, and wherewith the ink back pressure acting on the print head can be maintained more or less constant, irrespective of the position of the print head, so that good printing performance can be secured.

According to a first aspect of the present invention, an ink jet recorder is provided which comprises: an ink jet head for ejecting ink onto a recording medium; an ink tank for supplying ink to the ink jet head; an ink jet head moving device for moving the ink jet head up and down relative to the ink tank; a head position detector for detecting the up and down position of the ink jet head; and a pressure adjuster for adjusting the pressure of the ink supplied to the ink jet head from the ink tank based on detection signals from the head position detector.

By implementing the ink jet recorder of the present invention, the up and down position of the ink jet head is detected by the head position detector, and the ink pressure acting on the ink jet head is maintained more or less constant by the pressure adjuster based on the detection results, irrespective of the vertical position of the head. Thus constant printing performance can be secured.

In the recorder of the present invention, the pressure adjuster may comprise a fluid level regulator attached to the ink tank for varying the height of the ink level in the ink tank, and a controller that drives the fluid level regulator based on detection signals from the head position detector, thereby controlling the ink level height in the ink tank. The ink pressure acting on the print head can easily be adjusted by using such a fluid level regulator to vary the ink level in the ink tank. The fluid level regulator may be an ink tank moving device for moving the ink tank up and down. The ink fluid level can easily be varied with the ink tank moving device.

The ink tank moving device may be configured, for example, with a rack attached to the ink tank, extending vertically up and down, a pinion gear that meshes with the rack, and a drive device for turning the pinion gear. The ink jet head moving device may comprise a carriage for holding the ink jet head, a support member that supports the carriage so that it can be moved up and down, and a carriage drive device for moving the carriage on the support member and along the support member. The support member may include a horizontal beam for supporting part of the carriage so that it can slide and a pair of vertical beams that support both ends of the horizontal beam so that it can slide. By the ink head moving device, the ink jet head is made freely movable up, down, left, and right in a plane parallel to the recording medium. The carriage drive device may contain, for example, a pair of pulleys, a belt wound about the pulleys and joined to the carriage, and a motor for turning one of the pulleys.

The ink jet recorder of the present invention may also comprise a purging device having a suction cap that caps the ink jet head and sucks ink therefrom. The pressure adjuster may cause a negative pressure to act on the ink jet head, according to the up and down position of the head, when the ink jet head is recording, and may cause a positive pressure to act on the ink jet head nozzle or nozzles when the ink jet head is being purged by the purging device through the suction cap. When the ink jet head is in a printing area, the ink pressure acting on the ink jet head is maintained more or less constant, irrespective of the up and down position of the head, as already described. When the print head is in a restoration area (maintenance area) for which the purge device is provided, on the other hand, a positive pressure is made to act on the nozzle or nozzles of the ink jet head, whereby air bubbles once sucked from the ink jet head by the suction purge are prevented from flowing back inside the print head after the suction operation is finished.

According to a second aspect of the present invention, an ink jet recorder is provided which comprises: an ink jet head for ejecting ink onto a recording medium; an ink tank for supplying ink to the ink jet head through a tube; a head moving device for moving the ink jet head up and down relative to the ink tank; and a pressure adjuster for adjusting the pressure on the ink supplied from the ink tank to the ink jet head, in response to the movement of the ink jet head by the head moving device.

With the ink jet recorder according to the second aspect, the pressure adjuster adjusts the pressure on the ink supplied to the ink jet head from the ink tank in response to the movement of the ink jet head by the head moving device. Thus the ink pressure acting on the ink jet head is maintained more or less constant, irrespective of the up and down position of the head, and constant printing performance is assured. The pressure adjuster may comprise a fluid level regulator attached to the ink tank for varying the height of the ink level in the ink tank, and a controller for controlling the ink level in the ink tank by driving the fluid level regulator in response to the movements of the ink jet head by the head moving device. The fluid level regulator may be an ink tank moving device for moving the ink tank up and down, and a control circuit may be configured so that the drive signals input to the head moving device are also input to the ink tank moving device. When this is done, the ink tank can be moved up and down synchronously with the ink jet head.

DESCRIPTION OF THE PREFERRED EMBODIMENTS

Figure 1:
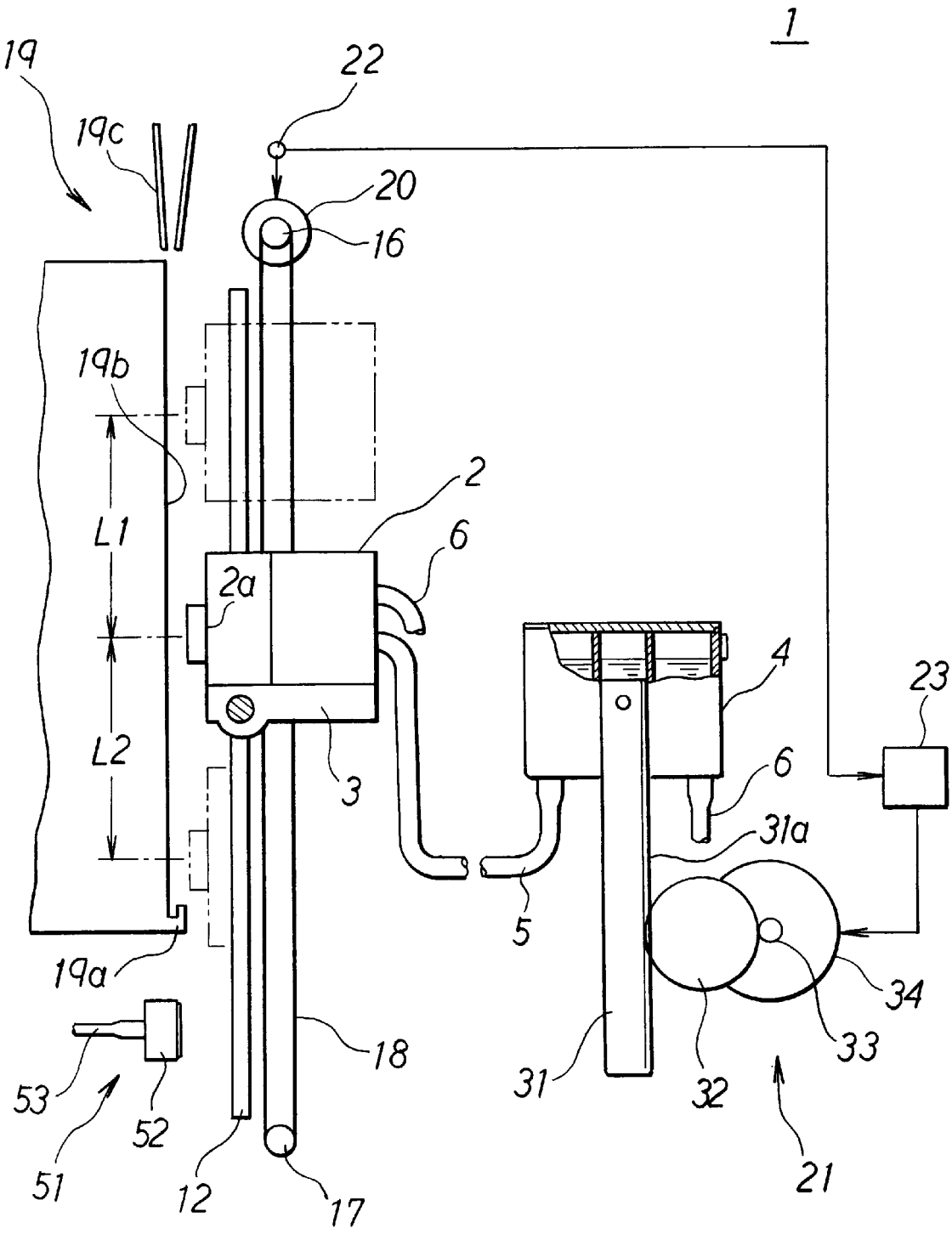
FIG. 1 shows a simplified side view of an ink jet recorder according to the present invention.

Specific examples of the ink jet recorder of the present invention are now described with reference to the drawings. As shown in FIG. 1, an ink jet recorder 1 comprises a head unit 2 which includes a rectangular print head 2*a*. The print head 2*a* is supported on the head unit 2 so that it is inclined in its longitudinal dimension for the purpose of enhancing print density. (Cf. head 2*a* represented by broken lines in FIG. 2.) The head unit 2 is mounted on a carriage 3. The print head 2*a* of the head unit 2 is connected to an ink tank 4 positioned away from the carriage 3, via first and second ink tubes 5 and 6, on the tank side.

Figure 2:
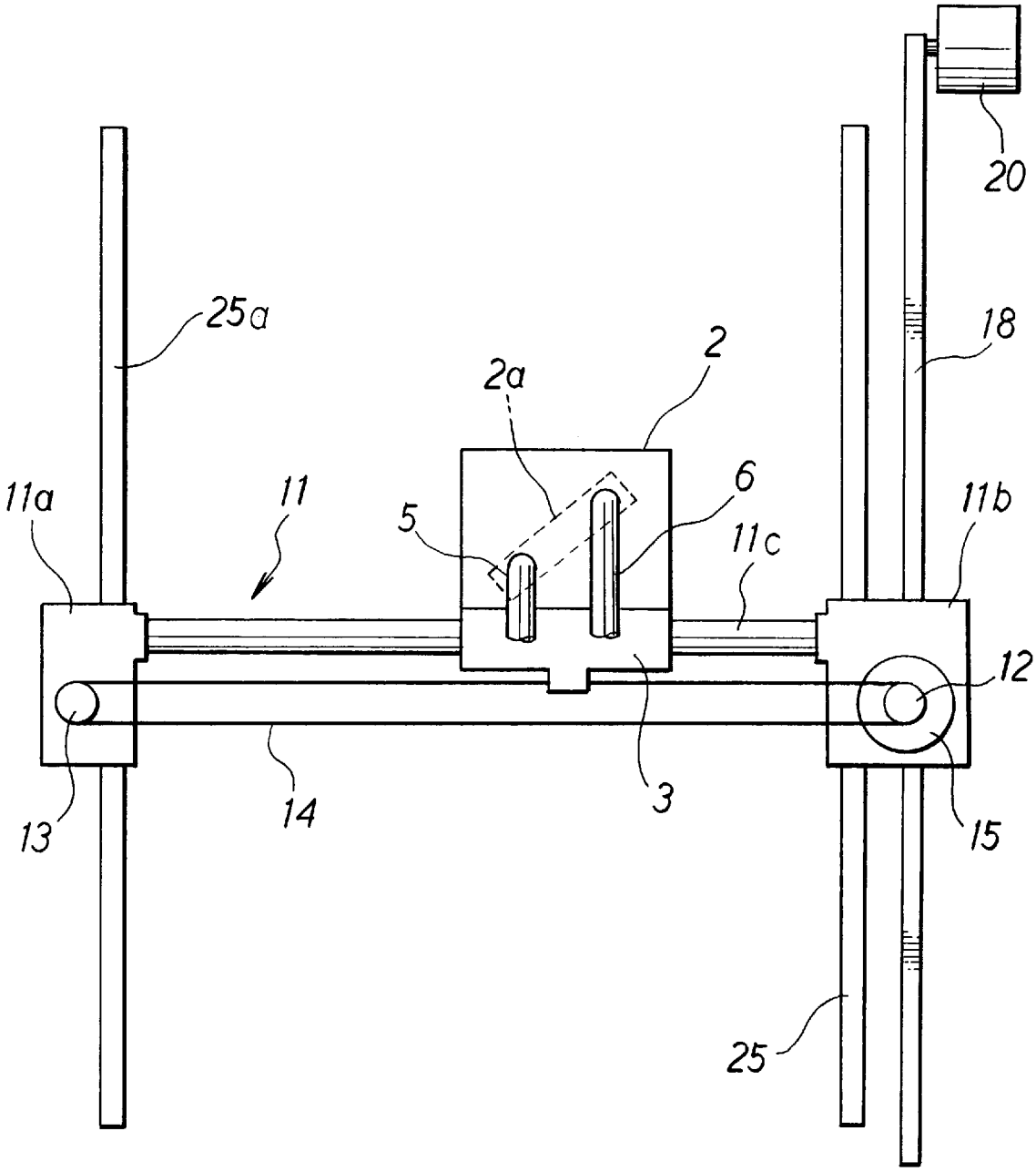
FIG. 2 shows a simplified view of the recorder diagrammed in FIG. 1, from the back (i.e. the right side in FIG. 1)

The carriage 3 is supported on a movable platform 11, as diagrammed in FIG. 2, so that it can move left and right. More specifically, the movable platform 11 comprises left and right slides 11*a* and 11*b* that engage left and right guide rails 25*a* and 25*b* such that they can slide thereon, and a connecting rod 11*c* for connecting the left and right slides 11*a* and 11*b*. The carriage 3 is engaged to the connecting rod 11*c* so as to be movable thereon. Part of the carriage 3 is attached to a belt 14 that is wound about a drive pulley 12 provided on one slide 11*a* and a follower pulley 13 provided on the other slide 11*b*. The connecting, rod 11*c*, here, functions as a guide shaft when the carriage 3 moves left and right (horizontally). The carriage 3 is moved when the drive pulley 12 is turned by a horizontal-movement stepper motor 15, wherefore the print head 2 can be moved left and right.

Part of the one slide 11*b* of the movable platform 11 is securely attached to a belt 18 that is wound about a drive pulley 16 and follower pulley 17 positioned at a constant interval vertically, as diagrammed in FIG. 1. The drive pulley 16 is driven so as to turn by a vertical-movement stepper motor 20, thereby moving the movable platform 11. Thus the print head 2*a* can be moved to a printing position at any height within the range bounded by lengths L1 and L2 from a reference position (that being the position of the head 2*a* represented by the solid lines in FIG. 1).

A paper support table 19 is provided opposite the carriage 3 that moves throughout the range of up, down, left, and right movements of the carriage 3 (i.e. the print head 2*a*). The paper support table 19 is set in place so that the support surface 19*b* thereof is made vertical. At the lower end of the paper support table 19 is formed a support piece 19*a* for holding the printing paper. A hopper 19*c* into which paper is inserted is positioned at the top of the support surface 19*a*.

During printing operations, the fluid level inside the ink tank 4 is usually made lower than the nozzle face of the print head 2*a* so that a negative pressure acts on the nozzle or nozzles. A prescribed volume of ink drops is ejected by the action of an actuator or actuators of the print head 2*a*. As described already, when the movable platform 11 is moved along the guide rails 25*a* and 25*b* in order to effect printing, the vertical position of the print head 2*a* changes. As this vertical position changes, so does the vertical positional relationship between the print head 2*a* and the ink level inside the ink tank 4, and the back pressure (water head) acting on the print head 2*a* also varies. When the extent of this variation is large, print performance is adversely affected. Thus it is necessary to adjust the ink pressure acting on the print head 2*a* in response to the vertical position of the print head 2*a*.

That being so, the vertical position of the ink level inside the ink tank 4 is made alterable by a fluid level regulator 21. Together therewith, a head position detector 22 that detects the vertical position of the print head 2*a* is connected to the stepper motor 20. When signals from this head position detector 22 are received by a controller such, for example, as a microcomputer 23, the fluid level regulator 21 is driven so that the ink tank 4 is moved up or down so as to correspond with changes in the vertical position of the print head 2*a*, thereby changing the vertical position of the ink fluid level.

The head position detector 22 either detects how far the stepper motor 2 has turned, or determines the quantity of signals sent to the stepper motor 20, and thereby detects the vertical position of the print head 2*a*. Either an optical or mechanical type of detecting sensor may be used in the head position detector 22 for detecting positions of the print head 2*a*.

The fluid level regulator 21 comprises a rack 31, having a rack gear 31*a*, that is attached to the ink tank 4 and extends vertically up and down, a pinion gear 32 that meshes with the rack gear 31*a*, another pinion gear 33 that meshes with the pinion gear 32, and a tank-moving stepper motor 34 that serves as a drive device for turning the pinion gear 32 via the pinion gear 33, in response to the vertical position of the print head 2*a*. How far the stepper motor 34 turns is controlled by the fluid level regulator 23 in response to changes in the vertical position of the print head 2*a*.

Figure 3:
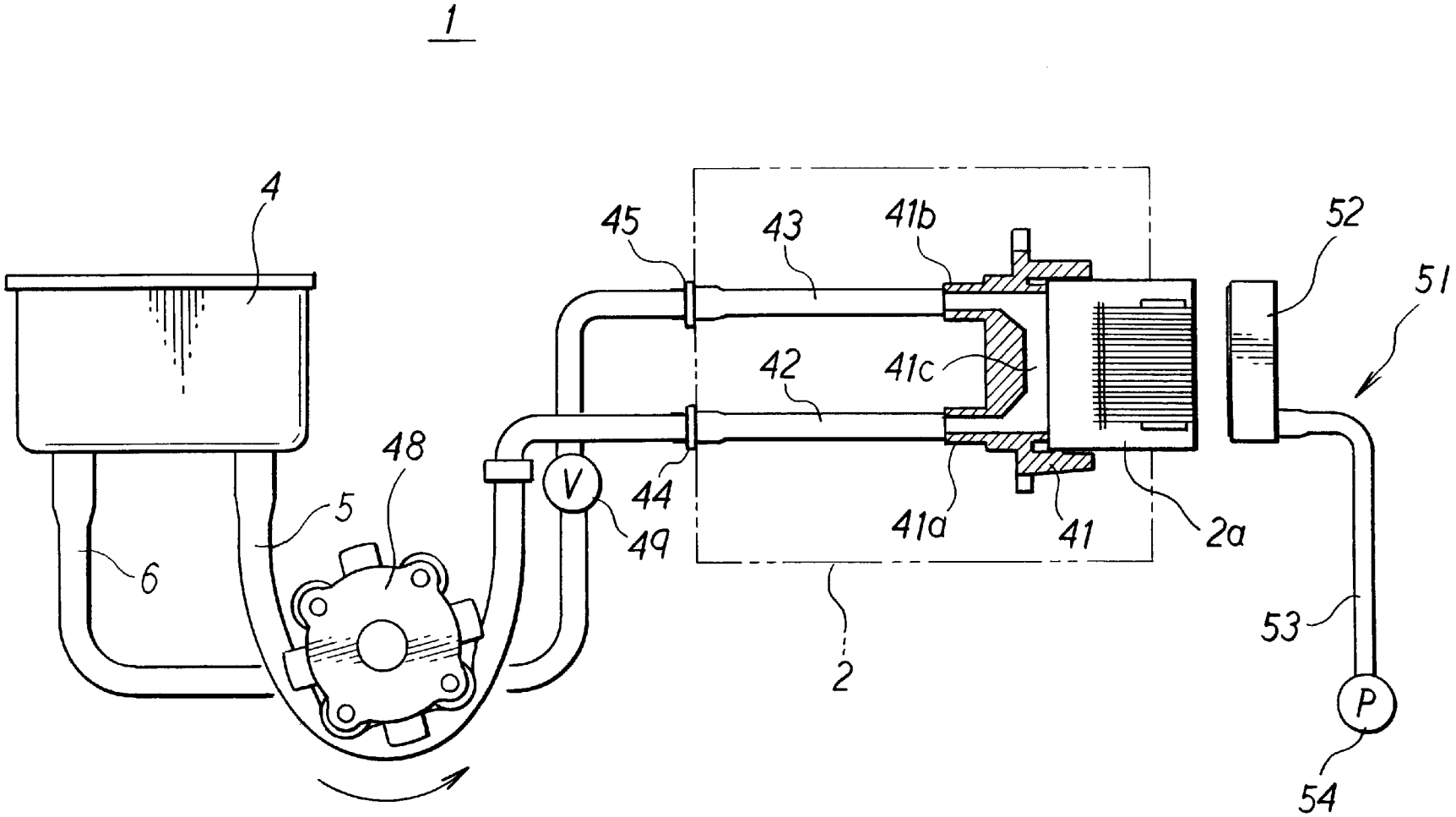
FIG. 3 is a diagram of the ink circulation path between an ink tank and a print head in an ink jet recorder according to the present invention.

The relationship between the print head 2*a* and the ink tank 4 is described next in conjunction with FIG. 3. The head unit 2 comprising the print head 2*a* rides on the carriage 3, and the movements of the print head 2*a* and carriage 3 are controlled either by the controller 23 or by a separately provided controller. More specifically, during printing operations, when the carriage 3 moves back and forth over areas (printing areas) opposite the printing paper (not shown), the print head 2*a* ejects ink onto the paper by selectively activating a plurality of actuators based on the print data. When printing is not being done, on the other hand, the carriage 3 moves to a maintenance area (described below) outside of the printing areas and waits there.

The head unit 2 comprising the print head 2*a* further comprises a manifold 41 that is connected to the print head 2*a* and that distributes ink to the plurality of actuators in the print head 2*a*, a first head-side ink tube 42 connected at one end thereof to an ink intake port 41*a* in the manifold 41, and a second head-side ink tube 43 connected at one end thereof to an ink discharge port 41*b* in the manifold 41. The ink intake port 41*a* and the ink discharge port 41*b* of the manifold 41 communicate with each other through an ink sump 41*c* that communicates with the ink chambers in the actuators of the print head 2*a*. The other ends of the first and second head-side ink tubes 42 and 43 are connected to the first and second tank-side ink tubes 5 and 6, at one end thereof, through joints 44 and 45.

The first tank-side ink tube 5 is connected at its other end to the ink tank 4, midway along which is provided a circulating pump 48. The second tank-side ink tube 6 is connected at its other end to the ink tank 4, midway along which is provided a two-way valve 49. This two-way valve 49 is only opened when the circulating pump 48 is being driven.

When a circulation purge is being performed, the circulating pump 48 is driven and, at the same time, the two-way valve 49 is opened, so that ink is supplied from the ink tank 4 to the ink sump 41*c* in the manifold 41 through the ink tubes 5 and 42, and ink is recovered into the ink tank 4 from the ink sump 41*c* through the ink tubes 43 and 6. In this way air bubbles are removed from the circulation flow path. By positioning baffle plates (not shown) inside the ink tank, recovered air bubbles can be prevented from flowing back out through the ink tube 5.

Below the paper support table 19 (cf. FIG. 1) is provided a suction purge unit 51 for sucking ink out of the print head 2*a*. This suction purge unit 51 comprises a suction cap 52 that covers the nozzle surface on the print head 2*a*, and a suction pump 54 that is connected to the suction cap 52 through a pipe 53. The nozzle surface of the print head 2*a* is covered by the suction cap 52, and the ink is sucked out to perform a purge. The area over which this purge unit is positioned is called the maintenance area. It is an area that is different from the printing area opposite the printing paper. The suction purge unit 51, controlled by the controller 23, is drive-activated in cases when ink is not discharged or is discharged only poorly.

In the purge unit 51, as described above, when ink is loaded into the print head 2*a*, the suction cap 52 is moved toward the print head 2*a* by a cap drive device (not shown), thereby covering the nozzle surface, the two-way valve 49 is opened under the control of the controller 23, and, at the same time, the ink circulating pump 48 is driven so that it turns. When this is done, the ink passes from the ink tank 4, through the first tank-side ink tube 5 and the first head-side ink tube 42, and is thus supplied to the ink sump 41*c* of the manifold 41, whereupon it passes through the second head-side ink tube 43 and the second tank-side ink tube 6, and is thus returned to the ink tank 4. Then, the two-way valve 49 is closed and, at the same time, the ink circulating pump 48 is stopped in a condition that does not block the first tank-side ink tube 5. After that, the suction pump 54 is driven, whereby ink is sucked out from the ink tank 4 through the suction cap 52, and ink is loaded into the actuators in the print head 2*a*. During printing operations, ink is supplied from the ink tank 4 due to the decline in pressure resulting from ink ejecting at the print head 2*a*.

When the print head 2*a* has been moved to a prescribed printing position by the movement of the movable platform up or down, how far up or down this movement was is first detected by the head position detector 22.

Next, the controller 23 receives detection signals from the head position detector 22, causes the stepper motor 34 to turn by a prescribed amount, based on the signals detected, thereby turning the pinion gear 32 via the pinion gear 33, and hence altering the vertical position of the ink tank by the meshing of the pinion gear 32 and the rack gear 31*a* of the rack 31. As a result, the vertical positional relationship between the print head 2*a* and the ink level in the ink tank 4 is maintained constant. Hence it is possible to maintain the back pressure on the ink that acts on the print head 2*a* more or less constant, irrespective of changes in the up and down position of the print head 2*a*, thus making it possible to continually secure constant printing quality.

When printing is stopped, the carriage 3 moves to the maintenance position opposite the purge unit 51. In this position, the suction cap 52 of the purge unit 51 caps the print head 2*a*. Then, when the circulating pump 48 is drive and the two-way valve 49 is opened to remove air bubbles from the ink tubes 5 and 42, a circulation path is formed so that ink flows from the ink tank 4, through the first ink-tubes 5 and 42, to the ink sump 41*c* in the manifold 41, and back through the second ink tubes 43 and 6, thus being returned to the ink tank 4. Ink is circulated through this circulation path and air bubbles in the circulation path are removed.

The guide rails 25*a* and 25*b* extend across the space between the printing area and the maintenance area. Therefore, when the carriage 3 has moved from a printing area to the maintenance area, the vertical position of the ink tank 4 is changed in response to changes in the vertical position of the print head 2*a*. When that is done, the back pressure on the ink acting on the print head 2*a* may be made the same as during printing operations. However, the fluid level in the ink tank 4 may be higher than the nozzles in the print head 2*a*, causing a positive pressure to act on the nozzles. By so doing, the air bubbles that are first sucked inside the suction cap 52 can be prevented from flowing back inside the print head 2*a* after the suction pump 54 is stopped.

In the embodiment described in the foregoing, movement of the print head 2*a* is detected by the head position detector 22, the fluid level regulator 21 is driven by the controller 23 based on the results of such detection, and the vertical position of the ink tank 4 is varied accordingly. The present invention, however, is not limited to such a configuration. It may also be configured such that, for example, the fluid level regulator 21 is driven and the vertical position of the ink tank 4 is changed in response to the movements of the print head 2*a*. If, for example, the signals input to the vertical-movement stepper motor 20 are simultaneously input to the tank-moving stepper motor 34, the print head moving stepper motor 20 and the ink tank moving stepper motor 34 can be linked so that the ink tank 4 is moved by an amount that corresponds with the amount of movement of the print head 2*a*. With this embodiment it is possible to eliminate the print head position detector. Similarly, the fluid level regulator is not limited to the use of rack and pinion gears. Instead, adjustments may be made using a belt mechanism like the ones that move the carriage 3 and the movable platform 11.

In the embodiments described in the foregoing, moreover, the ink tank is not described in any particular detail, but this ink tank need not consist solely of one ink tank for supplying ink directly to the print head. Instead it may consist of a large-volume main tank, and a subtank positioned between the main tank and the print head.

In the embodiments described in the foregoing, furthermore, the print head can move within a prescribed range from side to side as well as up and down, but this does not pose a limitation so long as the vertical position of the print head can be changed. The present invention comprehends not only cases where the print head moves up and down in the vertical, but also cases where it moves on a diagonal that includes a vertical directional component. The present invention may also be applied to recording apparatuses such as ink jet recorders having multiple paper support tables of differing heights, wherein the print head (or carriage) can be moved into a printing position above those paper support tables, so that envelopes and other recording media can be set in position on a suitable paper support table according to their thickness, in which condition the recording medium is moved to facilitate the printing of such printing data as names and addresses without moving the print head. The present invention may also be applied to recorders having paper support tables to which printing paper is supplied continuously in the lateral direction.

In the embodiments described in the foregoing, moreover, the ink level is changed by moving the ink tank up and down. it is also possible, however, to place something like an air bag the volume of which is variable inside the ink tank and change the ink level by causing the air bag to expand or contract, or to change the ink level by any of various other methods, or to adjust the ink pressure acting on the print head by any of various methods.

What is claimed is:

1. An ink jet recorder comprising:

an ink jet head for ejecting ink onto a recording medium;

an ink tank for supplying ink to the ink jet head;

an ink jet head moving device for moving the ink jet head up and down relative to the ink tank;

a head position detector for detecting vertical position of the ink jet head; and a pressure adjuster for adjusting pressure on ink supplied to the ink jet head from the ink tank based on detection signals from the head position detector.

2. The ink jet recorder according to claim 1, wherein the pressure adjuster comprises a fluid level regulator attached to the ink tank for changing ink level in the ink tank, and a controller for driving the fluid level regulator based on detection signals from the head position detector and controlling height of ink level in the ink tank.

3. The ink jet recorder according to claim 2, wherein the fluid level regulator is an ink tank moving device for moving the ink tank up and down.

4. The ink jet recorder according to claim 3, wherein the ink tank moving device has a rack attached to the ink tank, extending vertically up and down, a pinion gear that meshes with the rack, and a drive device for turning the pinion gear.

5. The ink jet recorder according to claim 1, wherein the ink jet head moving device comprises a carriage that holds the ink jet head, a support member for supporting the carriage so as to be movable up and down, and a carriage drive device for moving the carriage on and along the support member.

6. The ink jet recorder according to claim 5, wherein the support member has a horizontal beam for supporting part of the carriage so that the part can slide thereon, and two vertical beams for supporting the horizontal beam at two ends thereof so that the horizontal beam can slide thereon.

7. The ink jet recorder according to claim 5, wherein the carriage drive device has a pair of pulleys, a belt wound about the pulleys and connected to the carriage, and a motor for turning one of the pulleys.

8. The ink jet recorder according to claim 1, further comprising a purge unit having a suction cap for capping the ink jet head and sucking ink therefrom, wherein the pressure adjuster causes a negative pressure to act on the ink jet head, according to vertical position of the head, when the ink jet head is recording, and causes a positive pressure to act on nozzles of the ink jet head when the ink jet head is being purged by the purge unit through the suction cap.

9. The ink jet recorder according to claim 1, wherein the head position detector detects vertical position of the ink jet head based on amount of movement of the ink jet head in vertical direction.

10. The ink jet recorder according to claim 1, wherein the ink jet head and the ink tank are connected by a pair of tubes, midway along one of which tubes is provided an ink supply pump.

11. The ink jet recorder according to claim 1, further comprising a support table for supporting recording media, placed in opposition to path of movement up and down of the ink jet head.

12. An ink jet recorder comprising:

an ink jet head for ejecting ink onto a recording medium;

an ink tank for supplying ink to the ink jet head through a tube;

a head moving device for moving the ink jet head up and down relative to the ink tank; and a pressure adjuster for adjusting pressure on ink supplied from the ink tank to the ink jet head, in response to movement of the ink jet head by the head moving device.

13. The ink jet recorder according to claim 12, wherein the pressure adjuster comprises a fluid level regulator attached to the ink tank for changing height of ink level in the ink tank, and a controller for driving the fluid level regulator, in response to movements of the ink jet head by the head moving device, and controlling height of ink level in the ink tank.

14. The ink jet recorder according to claim 13, wherein the fluid level regulator is an ink tank moving device for moving the ink tank up and down.

15. The ink jet recorder according to claim 14, wherein drive signals input to the head moving device are also input to the ink tank moving device, thereby the ink jet head and the ink tank are moved synchronously in vertical direction.

16. The ink jet recorder according to claim 14, wherein the ink tank moving device has a rack attached to the ink tank, extending vertically up and down, a pinion gear that meshes with the rack, and a drive device for turning the pinion gear.

17. The ink jet recorder according to claim 12, wherein the head moving device comprises a carriage that holds the ink jet head, a support member for supporting the carriage so as to be movable up and down, and a carriage drive device for moving the carriage on and along the support member.

18. The ink jet recorder according to claim 17, wherein the support member has a horizontal beam for supporting part of the carriage so that the part can slide thereon, and two vertical beams for supporting the horizontal beam at two ends thereof so that the horizontal beam can slide thereon.

19. The ink jet recorder according to claim 17, wherein the carriage drive device has a pair of pulleys, a belt wound about the pulleys and connected to the carriage, and a motor for turning one of the pulleys.

20. The ink jet recorder according to claim 17, further comprising a purge unit having a suction cap for capping the ink jet head and sucking ink therefrom, wherein the pressure adjuster causes a negative pressure to act on the ink jet head, according to vertical position of the head, when the ink jet head is recording, and causes a positive pressure to act on nozzles of the ink jet head when the ink jet head is being purged by the purge unit through the suction cap.

21. The ink jet recorder according to claim 12, further comprising a support table for supporting recording media, placed in opposition to path of movement up and down of the ink jet head.

* * * * *